United States Patent [19]

Dressel et al.

[11] 4,431,063

[45] Feb. 14, 1984

[54] DRIVE MECHANISM FOR DRILL

[75] Inventors: Michael O. Dressel, Englewood; Horace M. Varner; LaValle V. Brummert, both of Littleton; John W. Bodle, Castle Rock, all of Colo.

[73] Assignee: The Bendix Corporation, Southfield, Mich.

[21] Appl. No.: 309,867

[22] Filed: Oct. 9, 1981

[51] Int. Cl.[3] ..... B23Q 5/00

[52] U.S. Cl. ..... 173/149; 173/145; 74/840; 175/114

[58] Field of Search ..... 173/145, 149, 159, 141; 175/113, 114, 118, 121; 74/840

[56] References Cited

U.S. PATENT DOCUMENTS

| | | | |
|---|---|---|---|
| 527,814 | 10/1894 | Sauer | 173/145 X |
| 4,128,133 | 12/1978 | Hug | 173/149 |
| 4,172,391 | 10/1979 | Dressel | 173/145 X |
| 4,273,199 | 6/1981 | Blanz | 173/149 |
| 4,290,494 | 9/1981 | Blanz | 173/149 |

FOREIGN PATENT DOCUMENTS

| | | | |
|---|---|---|---|
| 2063421 | 6/1981 | United Kingdom | 173/149 |

*Primary Examiner*—Frederick R. Schmidt
*Assistant Examiner*—Steven P. Schad
*Attorney, Agent, or Firm*—Robert C. Smith; W. F. Thornton

[57] ABSTRACT

A drive mechanism for a drill provides both rotational drive and axial feed for a drill of substantial diameter such as those used to drill holes for roof bolts in mine shafts. A plurality of sprockets carry two chains of drive links which interlock around the drill shaft with each drive link having depressions which mate with scroll-like projections on the drill shaft. For axial feed, the sprockets are driven from worm drives in separate housings on each side of the chains, the worm drives being driven from gears in a gearbox which are connected through a differential gearset to a hydraulic motor. A second hydraulic motor also drives through the differential gearset to rotate the drill shaft and the entire drive chain assembly. A large diameter face seal serves as the partition between the chain drive assembly and the gearbox. The rotatable chain drive assembly includes openings between the worm drive housings to permit rock fragments and other debris which falls into the chain drive assembly to escape from the side without jamming the chain drive. A stationary housing which encloses the chain drive assembly includes openings to permit the egress of debris and also bars across the openings to prevent an operator from injury by inadvertently coming into contact with the rotating chain drive assembly.

7 Claims, 4 Drawing Figures

77
10
20
DRIVE LINK SCROLL INTERFACE
22
18'
38'
32
34
38'
24
26
28'
36a
30
36b
36
12
SCROLL NOTCH (INTERFACES WITH MALE PROJECTION)
14
16

DRIVE MECHANISM FOR DRILL

This invention relates to a drive mechanism for a drill of a type used to drill elongated holes in the roofs of mine shafts. The drilled holes are used to receive roof bolts which are, insofar as possible, secured into rock to prevent the falling or collapse of the mine shaft roof. Typically such mine shaft roofs are secured by a large number of such roof bolts, e.g., one for each four feet or so.

A drill drive which as been found to be effective for drilling such roof bolt holes is described in U.S. Pat. No. 4,172,391 filed in the name of Michael O. Dressel, one of the coinventors herein. This drive mechanism includes means for translating and rotating a flexible drill shaft consisting of a string of articulated shaft elements which, when rotated in the drilling direction, tend to tighten and lock together to form a rigid drill shaft and which, when turned in the opposite direction, unlock from each other to cause the shaft to become flexible so that it can be curved as needed for storage. Such a drilling mechanism and shaft is usually carried on a mining vehicle which is built sufficiently low that it, and an operator, can move through mine shafts no more than four feet tall. Thus most of the drill shaft must be stored horizontally since it is long enough to drill holes to ten feet or more up into the roof of the mine.

The drill drive mechanism includes a chain drive with a chain consisting of special links on each side of the drill shaft, each link including a hollow center section adapted to enclose approximately one half the circumference of the drill shaft and containing internal grooves which mate with helical projections on the drill shaft sections when the links are interlocked around the shaft. These special links also include projections which interlock with corresponding projections on the opposite chain, thus causing the special chain links to be tightly locked around the shaft. To cause the shaft to rotate, the entire chain drive assembly is rotated with the mating helical projections on the shaft and the grooves on the links carrying the shaft in a rotating manner. To cause the shaft to move axially, the endless chain drive is actuated by means discussed below.

While the drive mechanism described above and in U.S. Pat. No. 4,172,391 operates quite successfully, it has been found that in the event of malfunction of the drill cuttings collection system, the drill head can pack with dust and small rock particles which tend to jam the chain drive mechanism. When this occurs, it is sometimes difficult to clear the drive head without disassembly. Also timeconsuming disassembly is required to inspect, repair, and adjust the tension of the drive chains. The applicants have determined that the drill drive mechanism will operate successfully if the rotating housing and the stationary exterior housing are opened up to permit the rock particles and other debris to be ejected from the drill head. The chain drive itself does not require lubricant; however, it is necessary to provide continuous lubrication for the worm drive to the chain sprockets as well as for the main gearbox. To adequately protect the gearbox, applicants have incorporated a high speed rotary seal between the bottom plate of the rotary housing, which serves also as the top of the gearbox, and the upper part of the sidewall of the gearbox, which is stationary. The gears driving the worm gears are in the gearbox and drive through seals in said bottom plate to the worm drive shafts which mesh with the chain drive gears in separate housings adjacent the chain and chain sprockets. These separate housings permit the use of a preferred worm drive lubricant which is separated from the transmission oil in the gearbox.

IN THE DRAWINGS

Figure 1:
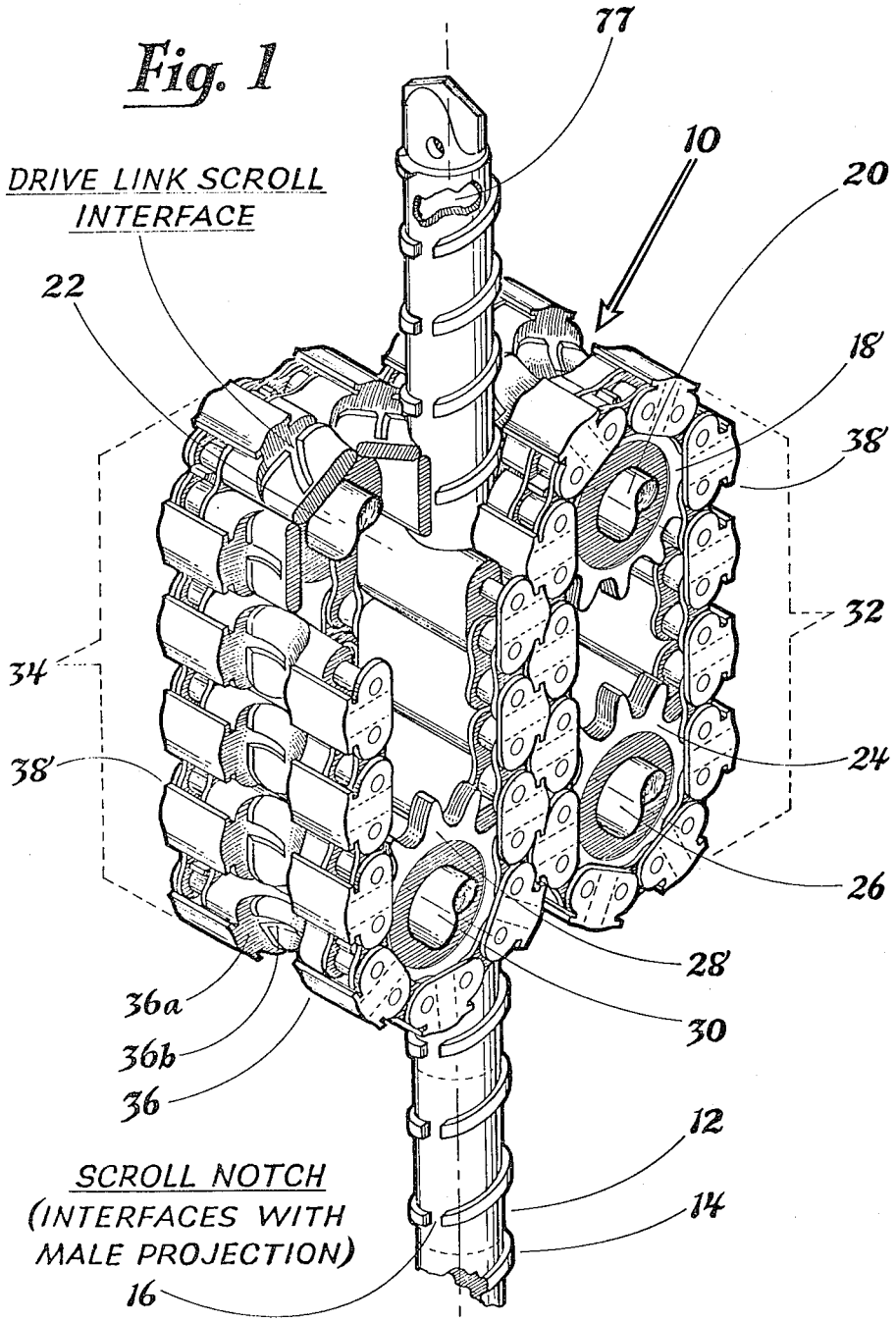
FIG. 1 is a perspective view, shown partly broken away, of a part of a drill drive mechanism incorporating our invention.

FIG. 1 is a perspective view, shown partly broken away for clarity, of the portion of the drive mechanism shown generally at numeral 10 whose function is to provide the axial drive of the drill shaft 12. It will be observed that shaft 12 incorporates a series of generally helically arranged projections 14 separated by notches 16 which are axially aligned as the shaft 12 passes through the drive mechanism 10. The shaft 12 which is formed of a plurality of connected sections can articulate behind the drive mechanism to facilitate bending when not under load. The drive mechanism includes two pairs of drive sprockets which are driven by means external to the assembly of FIG. 1, of which one such sprocket is shown at numeral 18 carried on a drive shaft 20. A similar sprocket is carried on a drive shaft 22 which is shown broken away to show other parts of the structure. Two additional drive sprockets (not shown) are located at the opposite ends of shafts 20 and 22. A set of four idler sprockets are also included, including sprockets 24 on a shaft 26 and sprocket 28 on a shaft 30. As with the drive sprockets, an additional pair of idler sprockets are carried at the opposite ends of shafts 26 and 30.

Carried on the above described sprockets are a pair of roller chains 32 and 34, each of which includes a plurality of drive links 36 including projections 38 arranged to interlink at the center with the links surrounding the drill shaft 12. Each of the drive links 36 is formed with a hollow center section **36*a* which is adapted to wrap around one half (approximately) of the circumference of the shaft 12. This hollow section includes a pair of internal grooves 36*b* which mate with the helical projections 14 when the links are interlocked around the shaft 12. Thus, rotation of the drive shafts 20 and 22 results in causing the several grooves 36*b* to pick up and carry corresponding helical projections 14, thereby moving shaft 12 upward or downward depending upon the direction of rotation of the drive shafts. With several grooves contacting several of the helical projections 14** at all times, excessive loading on any single groove or projection is avoided. Obviously, the grooves and projections may be reversed, i.e., grooves on the drill shaft and projections on the drive links.

Figure 2:
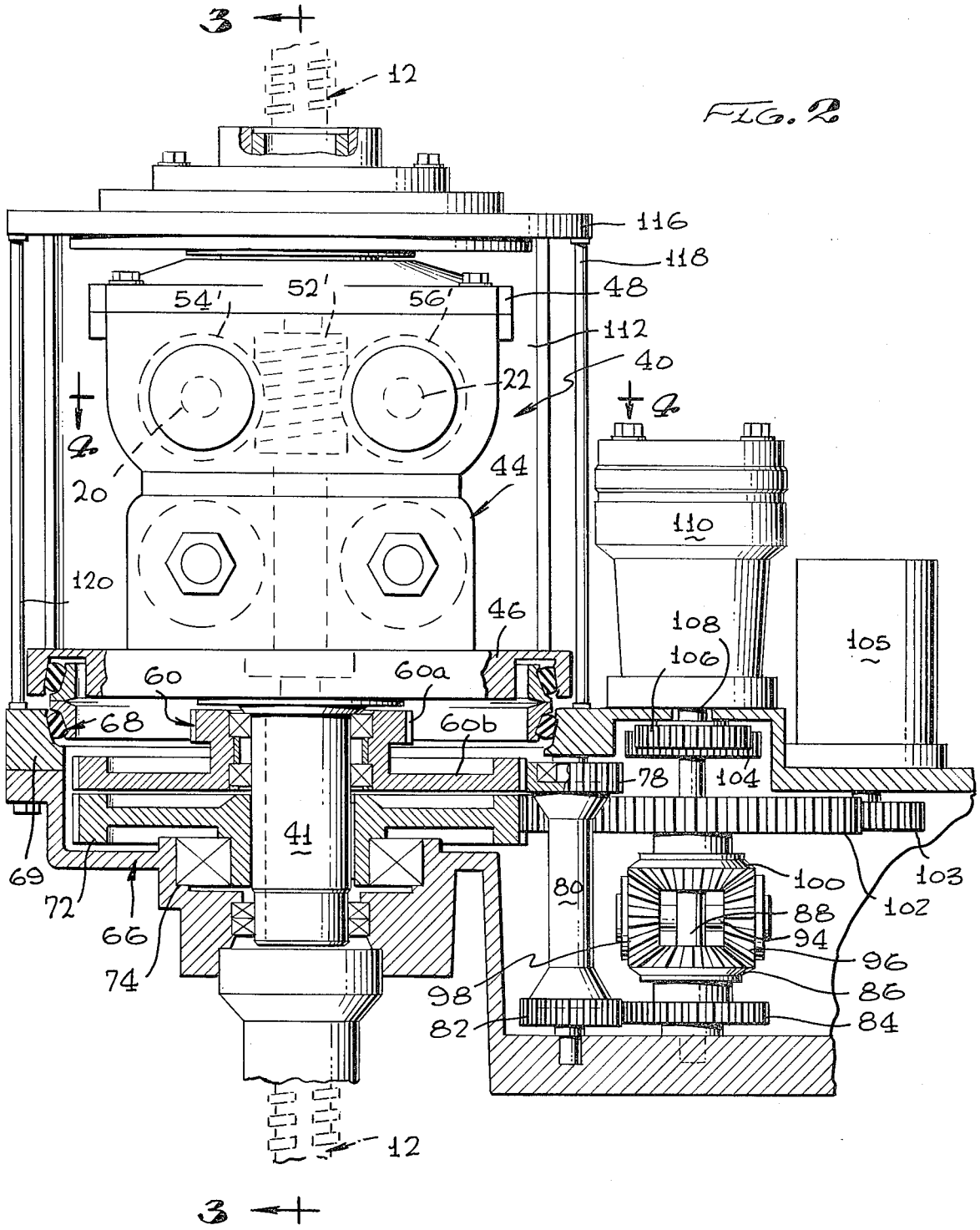
FIG. 2 is a sectional view of our drill drive mechanism showing parts and structure not visible in FIG. 1.

FIG. 2 is a sectional view showing the general arrangement of the housing 40 carrying the chain drive of FIG. 1 and the gear drive means for axially and rotatably driving the drill shaft 12. Housing 40, which is supported on a rotatable shaft 41, consists of a pair of housing members 44 and 42 supported on a base plate 46 and fastened to an upper plate 48.

A collar 49 bolted to upper plate 48 surrounds and guides the drill shaft 12 and includes a guide key 51 which aligns notches 16 and whose function is to assure alignment of the drill sections as they enter the drill head on retraction of the drill string.

Figure 3:
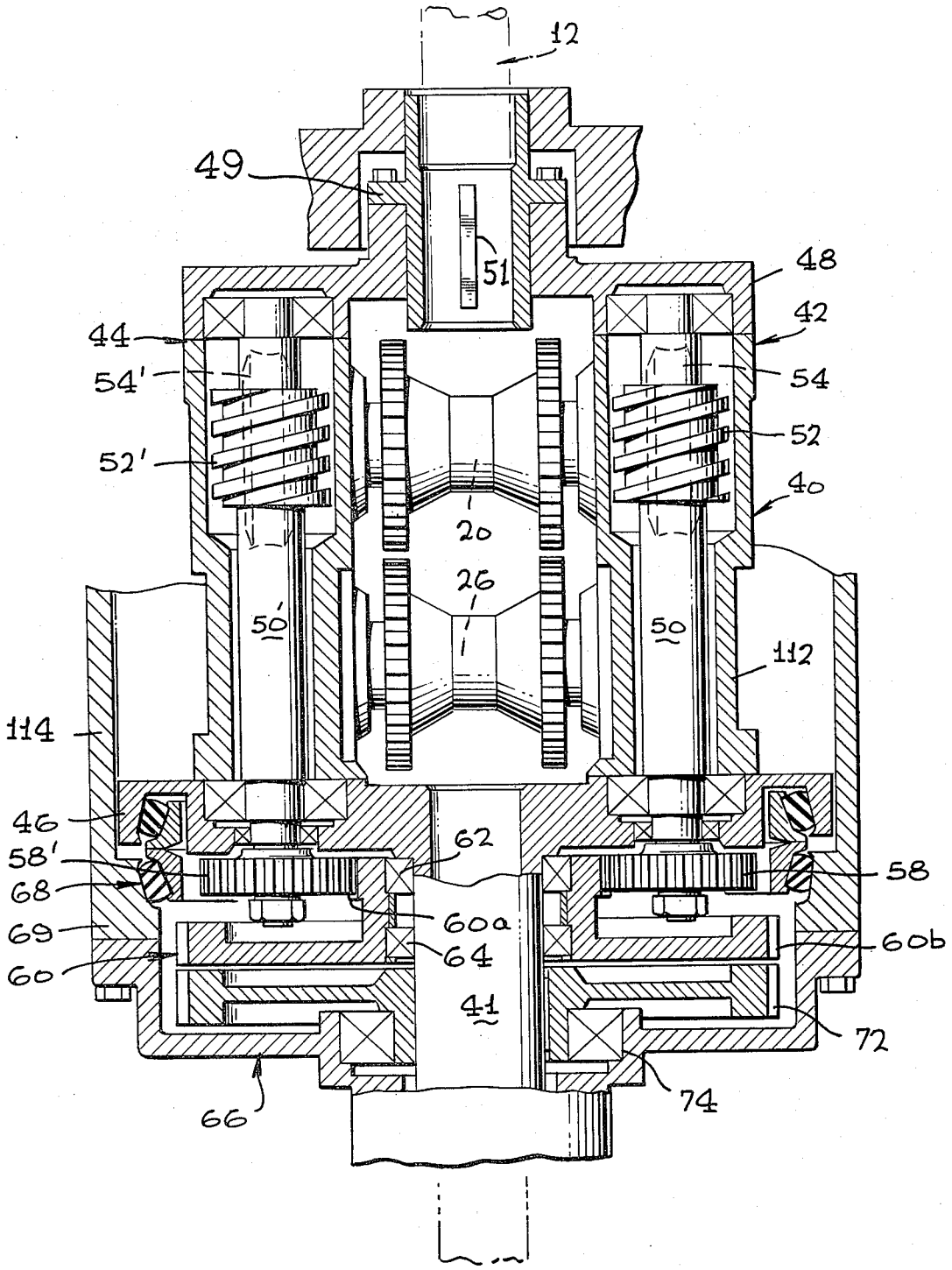
FIG. 3 is a sectional view taken along line 3—3 of FIG. 2.
Figure 4:
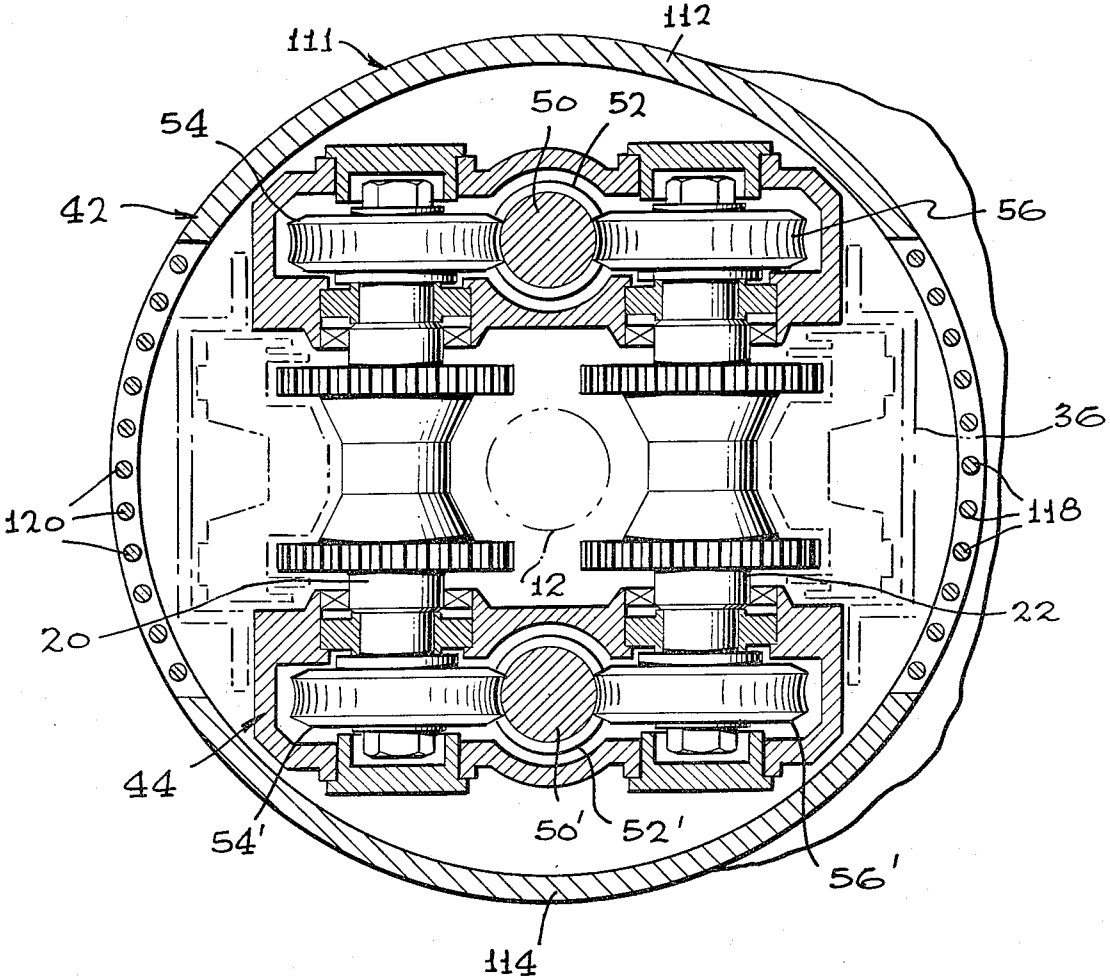
FIG. 4 is a sectional view taken along line 4—4 of FIG. 2.

In FIGS. 3 and 4, housing members 42 and 44 are shown each containing identical shafts 50, 50' carrying worm gears 52, 52'. Gears 52, 52' drive respective pairs of gears 54, 54' and 56, 56' (shown in FIG. 4) which drive the drive shafts 20 and 22. The shafts 50, 50' are turned by means of spur gears 58, 58' which mesh with the smaller diameter spur gear 60*a* of a double gear 60 supported concentric to shaft 41 by means of bearings 62, 64. The interiors of housings 42 and 44 are both sealed from the chains and sprocket driving the drill shaft 12 as well as from the opposite side of base plate 46 which permits these housings to be filled with a preferred type of worm drive lubricant rather than the transmission oil used in the gearbox 66.

Between gearbox 66 and the base plate 46 is positioned a large diameter face seal 68 which protects gearbox 66 from the rock particles and other debris adjacent the chain drive structure and which retains the transmission oil in gearbox 66 even though the drill drive unit may be operated horizontally or at an angle. The seal consists of a large diameter O-ring of synthetic rubber adjacent each of an upper rim member 69 of gearbox 66 and the lower face of base plate 46, each of which seals against a large diameter sealing ring, with the rings having adjoining flat surfaces to effect a high speed dynamic seal. This seal is commercially available from The Caterpillar Company, listed as parts 5M8647 and 5P1605.

The rotatable housing 40 is fastened to shaft 41 which is keyed to a large gear 72 supported on bearings 74 carried in the housing of gearbox 66. The double gear 60, in addition to the smaller diameter spur gear 60*a* referred to above, also carries a large diameter spur gear 60*b* which meshes with a gear 78 carried on a shaft 80. At the opposite end of shaft 80 is a gear 82 which meshes with a spur gear 84 keyed to a bevel gear 86. Bevel gear 86 forms part of a differential gearset which includes a centrally located shaft 88 and which has keyed to it a spider gear shaft 94 carrying pinion gears 96 and 98 engaged with bevel gear 86 and with an additional bevel gear 100. A spur gear 102 is keyed to bevel gear 100. Also keyed to shaft 88 is a spur gear 104 which engages a spur gear 106 carried on an output shaft 108 from a hydraulic motor 110 which effectively provides the axial drive for drill shaft 12.

Rotation of housing 40 and drill shaft 12 is accomplished by means of the large gear 72 which is pinned to shaft 41 such that housing 40 turns when gear 72 turns. Gear 72 turns when driven by spur gear 102 which is driven by a separate spur gear 103 carried on a second hydraulic motor 105 to effect rotational movement of the drill shaft 12.

Fastened to the gearbox 66 which actually forms part of a stationary housing shown generally at numeral 111 containing the rotating housing 40, are arcuate sidewalls 112 and 114 (see FIG. 4) to both of which is attached a cover plate 116 (FIG. 2). To allow the debris from the rotating housing 40 to escape the entire drill mechanism, a substantial part of the circumference of the external housing is open between the sidewalls 112 and 114. To protect operating personnel who might inadvertently attempt to put a hand in the housing opening while the mechanism is in operation, a number of vertical bars 118 and 120 are installed between the housing of gearbox 66 and the cover plate 116. The spaces between the bars are adequate to permit drilling debris to be ejected from the drill head and to prevent it from excessively packing into the space between the rotary housing 40 and the stationary housing 111.

The purpose of the differential drive heretofore described is to provide a controllable axial feed for the drill shaft 12, which is coordinated with the rotational drive to eliminate any axial feed caused by rotation of drill shaft 12. In the absence of an input from the axial feed drive motor 110 the large drive gear 72 will be driven through gears 102 and 103 from the rotational drive motor 105 with bevel gear 100 driving gear 86 at the same speed through pinion gears 96 and 98. The ratios through gears 84, 82, 78 and 60*a* and 60*b* are chosen such that gear 60 and 72 rotate at the same speed which effectively cancels axial movement of shaft 12. As hydraulic drive motor 110 is actuated, turning gears 106 and 104 the shaft 88 is also turned, resulting in rotation of spider shaft 94 and rotational movement of the pinion gears 96 and 98 and resulting change in rotational speed of bevel gear 86 relative to the speed of bevel gear 100. Rotation of gear 100 at a different speed from gear 86 resulting in driving compound gear 60 at a different speed from gear 72 to effect turning of the worm drive gears 58, 58' to actuate the chain drive as described above.

With the above arrangement, when the drill shaft is drilling upwardly, it is inevitable that some rock particles and other debris will be carried by the drill shaft 12 or fall into the top of the rotatable housing through the passageway for the drill shaft 12. These particles tend to cling to the links of the chain drive and are subsequently thrown toward the outside of the housing through centrifugal force resulting from the rotation of housing 40. The particles are then discharged outwardly through bars 118 and 120. This structure thus avoids the time consuming disassembly required to clean, replace or adjust the chain drive when housing 40 is closed on all sides. In addition, provision of separate housings 42 and 44 make it possible to use separate optimum lubricants for the worm drives and the gear box.

We claim:

1. A drive mechanism for a drill wherein said drill includes a shaft having a plurality of articulated attached sections and a notch cut axially along said shaft, said drill drive including an external housing, a rotatable housing within said external housing having a baseplate, a pair of chains in said rotatable housing formed of drive links, one portion of said drive links and said drill shaft having surface projections and another portion of said drive links and said drill shaft having mating grooves for mating with said projections to drive said drill shaft, conventional intermediate links between said drive links and drive means for driving said chains to move said drill shaft axially, and second drive means for rotating said rotatable housing to rotate said drill shaft:

characterized in that said rotatable housing includes openings of substantial size in close proximity to the outside surfaces of said chains to enable rock particles to escape therefrom, said external housing includes openings of substantial size to enable rock particles to escape from the body of said drive mechanism, said drive means for driving said chains includes a worm drive in an enclosed housing attached to said rotatable housing said second drive means is enclosed in a separate housing forming part of said external housing, and a large diameter rotary seal is positioned between said external housing and said baseplate.

2. A drive mechanism for a drill as set forth in claim 1 wherein said rotary seal includes a first large diameter metal ring having a dynamic face, a large diameter O-ring interposed between said metal ring and said baseplate, a second large diameter metal ring having a dynamic face in contact with the dynamic face of said first large diameter metal ring, and a large diameter O-ring interposed between said second large diameter metal ring and a portion of said external housing.

3. A drive mechanism for a drill as set forth in claim 1 wherein said worm drive housing and said separate housing are isolated from each other to permit the use of different lubricants in each housing.

4. A drive mechanism for a drill as set forth in claim 1 wherein said rotatable housing includes collar means supporting said shaft and a guide key in said collar means for assuring alignment of said drill shaft sections on retraction of said drill shaft.

5. A drive mechanism for a drill wherein said drill includes a shaft with a plurality of helically-arranged scroll projections on said shaft and a notch cut axially along the side of said shaft to expose notches between said helical scroll projections, said drill drive including a rotatable housing surrounding said drill shaft, a plurality of sprockets and a pair of chains in said housing carried on and driven by said sprockets, said chains being formed of drive links having concave contact surfaces with tangs extending therefrom mating with the notches between said helical scroll projections and linking projections on the outside edges thereof which mate with linking projections on drive links carried on the opposite of said two chains to hold said drive links in mesh with said drill shaft, conventional intermediate links connecting said drive links, and first gear means driving said sprockets, drive means connected to said rotatable housing including a drive shaft and second gear means pinned to said drive shaft, first motor means connected to said second gear means, third gear means coaxial with and rotatable relative to said second gear means including a large diameter gear and a small diameter gear connected to drive said first gear means, a differential gearset including first and second bevel gears arranged for differential rotation and first and second spur gears pinned to said first and second bevel gears, respectively, said second spur gear being in mesh with said second gear means;

a gear shaft including a third spur gear meshed with said large diameter gear and a fourth spur gear meshed with said first spur gear;

second motor means connected to said differential gearset to produce differential operation of said gearset and hence a differential in the rotational speeds of said second and third gear means to rotate said first gear means to drive said sprockets; and a stationary housing enclosing said rotatable housing, said gear means and said differential gearset;

characterized in that said rotary housing includes a baseplate separating said sprockets, chains and said first gear means from a first part of said stationary housing enclosing said second and third gear means and said differential gearset, said rotary housing having openings of substantial size adjacent said drive links to enable rock particles to escape therefrom, a second part of said stationary housing surrounding said rotary housing having openings of substantial size to enable said rock particles to escape from the body of the drive mechanism, a rotary seal having a rotating portion attached near the periphery of said baseplate and a stationary portion attached near the periphery of said first part of the stationary housing, and separate housing means enclosing said first gear means.

6. A drive mechanism for a drill as set forth in claim 5 wherein said first gear means includes a worm gear assembly.

7. A drive mechanism for a drill as set forth in claim 5 wherein said openings in said second part of the stationary housing include a plurality of spaced bars to prevent injury to personnel.

* * * * *